US007405187B2

(12) United States Patent
Frankenbach et al.

(10) Patent No.: US 7,405,187 B2
(45) Date of Patent: Jul. 29, 2008

(54) CONCENTRATED PERFUME COMPOSITIONS

(75) Inventors: Gayle Marie Frankenbach, Cincinnati, OH (US); Timothy Clair Roetker, Fairfield, OH (US); David Matthew Cast, Phoenix, AZ (US); Thomas Jackson Kirk, Cincinnati, OH (US); George Endel Deckner, Cincinnati, OH (US); Michael Jude Leblanc, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/444,667

(22) Filed: Jun. 1, 2006

(65) Prior Publication Data

US 2007/0281874 A1 Dec. 6, 2007

(51) Int. Cl.
*C11D 3/50* (2006.01)

(52) U.S. Cl. ..... 510/101

(58) Field of Classification Search ..... 510/101
See application file for complete search history.

(56) References Cited

U.S. PATENT DOCUMENTS

| | | | | |
|---|---|---|---|---|
| 5,190,915 | A | 3/1993 | Behan et al. | |
| 5,447,644 | A | 9/1995 | Guénin et al. | |
| 5,468,725 | A * | 11/1995 | Guenin et al. | 512/2 |
| 6,620,437 | B2 | 9/2003 | Ewbank et al. | |
| 6,767,873 | B1 | 7/2004 | Fraser | |
| 2002/0010104 | A1 | 1/2002 | Ewbank et al. | |
| 2003/0232901 | A1 * | 12/2003 | Maleeny et al. | 523/102 |
| 2005/0176611 | A1 | 8/2005 | Caswell et al. | |

FOREIGN PATENT DOCUMENTS

| | | | |
|---|---|---|---|
| WO | WO 98/08927 | * | 3/1998 |

OTHER PUBLICATIONS 1994-1995 Catalog, Aldrich Company, 1994, p. 866.*

* cited by examiner

*Primary Examiner*—John R Hardee
(74) *Attorney, Agent, or Firm*—Mark A. Charles; David V. Upite; Kim William Zerby

(57) ABSTRACT

Concentrated perfume compositions are useful for incorporating perfume into fabric care compositions.

3 Claims, 1 Drawing Sheet

CONCENTRATED PERFUME COMPOSITIONS

FIELD OF INVENTION

The present invention relates to concentrated perfume compositions, and method of making fabric care compositions with the concentrated perfume composition.

BACKGROUND OF THE INVENTION

Fabric care compositions comprising dispersed lamellar phases are typically not miscible with perfume oils. However, perfuming the fabric compositions is essential to secure high consumer acceptance. Fabric care compositions with a pleasant neat product odor that also deliver a pleasant odor through the wash process and ultimately to dry fabrics are far more desirable to the consumer than un-perfumed fabric care products. The typical and conventional method of perfuming a fabric care composition comprising dispersed lamellar phases is to combine the perfume and the fabric care composition and apply a high level of mechanical energy until the perfume oil is subdivided and adsorbed by the lamellar species. The need to use a high level of mechanical energy leads to several problems. Compositions comprising lamellar phases are typically colloidal dispersions that are not thermodynamically stable. It is desirable for the fabric care composition comprising dispersed lamellar phases to be homogeneous in order to provide the consumer with uniform, acceptable performance with minimal consumer intervention (e.g. shaking the product to recombine phases). When such colloidal dispersions of lamellar phases are exposed to high mechanical energy to incorporate perfume, these compositions may become unstable and separate or form a high viscosity composition. Compositions that separate or form high viscosity phases are unacceptable because these compositions often have poor pour properties, inconsistent performance and/or an undesirable visual appearance.

Additionally the equipment needed to apply high mechanical energy is capital intensive and so such equipment is not always available to provide the level of energy needed to incorporate perfume, especially in economically developing geographies.

Alternately, in place of high mechanical energy, the process engineer may employ the tactic of adding perfume into the front end of product making or increase the residence time of the product in the mixing tank to thoroughly incorporate the perfume. While both approaches will increase the likelihood of perfume incorporation even with many perfumes that are difficult to incorporate, these approaches introduce other problems. Incorporating perfume at the beginning of product making of processing reduces flexibility and introduces a need for increased capital for storage of product variants. Also when perfume is incorporated in the front-end of a process, it is often introduced when other components are still hot and thus, a portion of the perfume volatiles can be lost resulting in sub-optimal product and wasted perfume materials. Increased residence time in the mixing tank is not a desirable solution as it reduces the product making capacity leading to shortfalls in shipping and increased manufacturing costs. Increasing the residence time in mixing tanks increases cycle time to make the product which effectively increases the costs associated with product making.

In today's marketplace, the consumer demands increased customization. This requires processing facilities to be more flexible than ever. Thus it is important to have the capability to differentiate a basic (or base) fabric care formulation just prior to packaging in order to simultaneously achieve maximum efficiency and customization capability. The present invention introduces a method of incorporating perfume at the back-end of product making that requires only simple low-energy mixing (e.g., static mixer).

An additional problem faced when making perfumed fabric care products is that some perfumes are much more difficult to incorporate into fabric care compositions comprising dispersed lamellar phases. Such perfumes are typically less polar perfumes (as further herein described below) are poorly incorporated or impossible to incorporate even after very high levels of mechanical energy are applied. Alternately, certain perfumes can be excluded from use based on poor incorporation related to the perfume's physical properties, but this approach limits the perfumer's and formulator's ability to make the best product and it limits the range of offerings available to satisfy the consumer's demands for customization in fabric care products.

Other challenges are presented by compositions comprising low level of dispersed lamellar phases. Such compositions are exceptionally difficult to perfume because the perfume must be adsorbed by the dispersed lamellar phase(s). When the percentage of dispersed lamellar phase(s) is lowered, without wishing to be bound by theory, less surface area is present for the adsorption of perfume oil. To further complicate this challenge, one skilled in the art may increase the perfume oil in such compositions to compensate for the reduced perfume deposition on fabrics. Thus the amount of oil that must be adsorbed is increased while the amount of surface area in the form of dispersed colloidal particles is decreased resulting in a situation wherein perfume incorporations is poor or near impossible even upon application of high mechanical energy.

There is a need for a wide range of perfume oils to be easily incorporated into compositions with very low to very high percents of dispersed lamellar phase(s) with little to no mechanical energy applied. There is a need to incorporate levels of perfume in fabric care products that require little or no mechanical energy.

There is a need for the concentrated perfume composition to have low flammability and/or low levels of water. One skilled in the art will appreciate that to maintain low costs in a product making environment, it is advantageous to utilize compositions that have low flammability, i.e., a high flash point (e.g., above 38° C.). Minimizing the water content (e.g., less than 10% water by weight of the composition) of the concentrated perfume composition is also advantageous. When water is present in the concentrated perfume composition, often mixing is necessary to maintain a homogeneous concentrated perfume composition.

There is also a need to provide a concentrated perfume composition that, in turn, can be added to an un-perfumed fabric care composition base as part of a late product differentiation processes.

SUMMARY OF THE INVENTION

The present invention accomplishes attempts to achieve one or more of these needs by employing, in one aspect of the present invention, a mixture of perfume and an amphiphile that is used to concentrated perfume to form a concentrated perfume composition. The use of certain amphiphiles may also allow for low levels of the amphiphiles and yet still yield the concentrated perfume composition.

Another aspect of the invention provides a concentrated perfume composition comprising at least about 70% of a perfume, by weight of the composition; and from about 1% to about 30% of an amphiphile, by weight of the composition, wherein the amphiphile is chosen from: (i) a nonionic, alkyl or alkyl-aryl alkoxylated surfactant; (ii) a nonionic with a bulky head group; (iii) an alkoxylated cationic quaternary ammonium surfactant; (iv) or combinations thereof.

Yet another aspect of the invention provides for a method of making a fabric care composition comprising the step of adding a concentrated perfume composition to a composition comprising a quaternary ammonium compound, wherein the concentrated perfume composition comprises: (a) at least about 70% of a perfume, by weight of the composition; and (b) from about 1% to about 30% of an amphiphile, by weight of the composition, wherein the amphiphile is chosen from: (i) a nonionic, alkyl or alkyl-aryl alkoxylated surfactant; (ii) a nonionic with a bulky head group; (iii) an alkoxylated cationic quaternary ammonium surfactant; or (iii) combinations thererof.

In one embodiment, the amphiphile comprises a polyoxyethylene sorbitan monolaurate (so called "TWEEN 20").

DETAILED DESCRIPTION OF THE INVENTION

Figure 1:
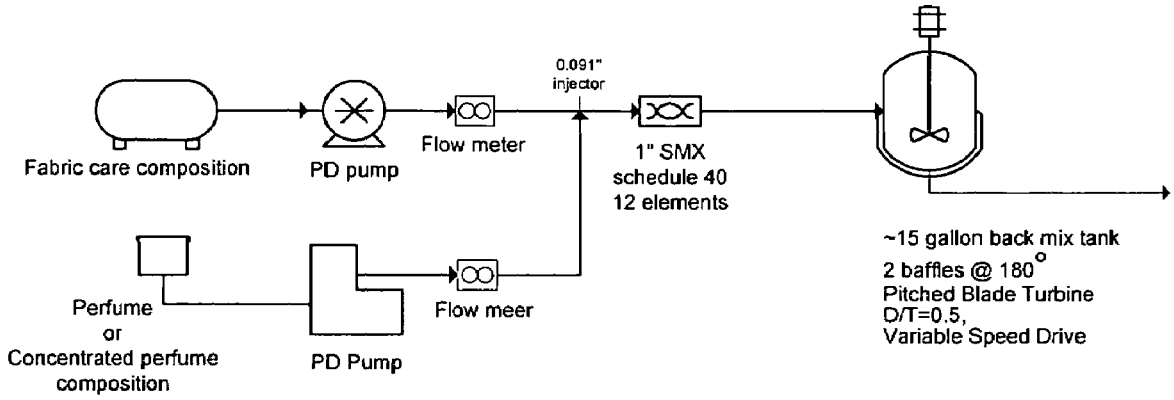
FIG. 1 is a schematic of a procedure for adding a concentrated perfume composition to the fabric care composition.

The concentrated perfume composition of the present invention comprises perfumes. In turn, perfumes are typically mixtures of polar and non-polar oils. A composition comprising oils, even when some of these oils are polar, is not easily dispersed in a water continuous composition such as a fabric care compositions. Not to be bound by theory, but a perfume must be finely subdivided in the continuous water phase of a fabric care composition to enable adsorption of the perfume by the dispersed lamellar phase(s). If the perfume oil is not finely divided, it will coalesce prior to adsorbing to dispersed lamellar phase(s) and thus the perfume will be incompletely or not at all incorporated into the final product.

Not to be bound by theory, but the degree to which the perfume will resist subdivision and incorporation into product via the application of mechanical energy is roughly correlated with the bulk polarity of the perfume as measured by the dielectric constant. Perfumes with a lower dielectric constant, or the less polar perfumes, are more likely to be difficult to incorporate into fabric care compositions comprising dispersed lamellar phase(s) (see Table 1) because such perfumes are more cohesive in an aqueous environment and thus require more mechanical energy to be subdivided in this environment. Some perfumes with low polarity can not be fully incorporated into a fabric care composition of the present invention even when the highest degree of mechanical is energy applied. Or as noted herein before, long residence time in a mixing tank together with high mechanical energy is required to achieve the desired product. Polarity is directly correlated with the dielectric constant and the chart below gives a measure of the perfume dielectric constant (higher dielectric constant=greater polarity) and the relative difficulty of incorporating the perfume. In general, lower polarity correlates with poorer incorporation.

TABLE 1 demonstrates the relationship between the polarity of a perfume (as measured by the Dielectric Constant) and ease of incorporation into the product.

| Perfume # | Dielectric Constant (ϵ) | Incorporation in Product |
|---|---|---|
| 1 | 6.38 | Poor |
| 2 | 6.74 | Poor |
| 3 | 6.69 | Borderline |
| 4 | 7.41 | Good |
| 5 | 7.94 | Good |
| 6 | 8.02 | Good |
| 7 | 8.49 | Poor |
| 8 | 8.79 | Good |
| 9 | 11.52 | Good |

Poor = Incorporation fails even with high mechanical energy and long mixing.
Borderline = Can incorporate with high mechanical energy and long mixing.
Good = Incorporates well with normal mechanical energy.

The present invention solves the problem of sub-dividing perfume in an aqueous continuous phase by addition of an amphiphilic agent to the perfume to produce the concentrated perfume composition of the present invention. Upon addition of the concentrated perfume composition to a continuous aqueous composition, the perfume is spontaneously subdivided as the amphiphilic agent is driven to the interface or bulk water phase. Not to be bound by theory, but when the amphiphilic agent is driven to the interface or bulk aqueous phase it releases chemical potential energy that may replace, in part or in whole, the mechanical energy typically needed to subdivide the perfume oil such that the perfume droplets can now be adsorbed onto the dispersed lamellar phase(s).

Since the concentrated perfume composition is spontaneously subdivided or subdivided with very low application of mechanical energy, the present invention attempt to solve the problems identified which include reducing the need for mechanical energy and/or excessive mixing time allowing for the fabric care compositions of the present invention to be made with modest processing equipment such as conventional stirring equipment or static mixtures rather than requiring complex collections of more complex/higher technological/energy intensive equipment. Perfumes that are difficult to incorporate, such as those with low polarity, can now be incorporated. Such perfumes can be incorporated at higher levels and/or can more easily be incorporated into low fabric softener active formulations. Perfumes can be incorporated into products sensitive to the application of high mechanical energy. Fabric care compositions can be made rapidly with a variety of different perfumes with minimal mechanical energy and little stirring just prior to packaging the composition thereby increasing flexibility and savings in processing cycle time at conventional manufacturing sites. Formulators and perfumers may now have increased flexibility to choose from a wider range of perfumes for incorporation into fabric care compositions.

The concentrated perfume composition utilized in the present invention provides a means of making an economical concentrated perfume composition to formulate a perfumed fabric care composition with a minimum amount of excess amphiphile. Excess amphiphile introduces unnecessary costs and further can lead to poor neat product odor of the fabric care composition. Poor neat product odor is known to negatively affect consumer acceptance. The concentrated perfume composition minimizes the use of added amphiphile costs and the risk of poor neat product odor is also minimized.

Adding the concentrated perfume composition to the fabric care composition may solve an additional problem related to fabric care compositions having a low percent of dispersed lamellar phase(s). Fabric care compositions with a low percent of dispersed lamellar phase(s) typically also have low viscosity and so over time these compositions separate into an aqueous and a lamellar phase. Now the present invention helps to solve this problem because when the concentrated perfume composition is added to the fabric care composition the effect is to increase the viscosity of the composition.

One aspect of the present invention provides a concentrated perfume composition wherein the perfume is present at a level of at least about 70%, by weight of the concentrated perfume composition. In another embodiment, the amphiphile is at level less than about 30%, by weight of the concentrated perfume composition. The concentrated perfume composition can optionally include an aqueous component, dye, antimicrobial agents, less than about 5% organic solvent, salt, or combinations thereof. In one embodiment, the concentrated perfume composition comprises less than about 5%, or 4%, or 3%, or 2%, or 1%, by weight of the composition, or substantially free, of a non-aqueous solvent.

Another aspect of the invention provides a method of making a fabric care composition comprising the step of adding a concentrated perfume composition of the present invention to a composition comprising a fabric softening active wherein preferably the composition comprising the fabric softening active is substantially free of a perfume.

The concentrated perfume composition comprises perfume preferably at a level of at least about 70%, or 75%, or 80%, or 85%, or 90%, or 91%, or 92%, or 93%, or 94%, or 95%; alternatively less than 99.9%, by weight of the concentrated perfume composition. A non-limiting set of perfumes suitable for the present invention are disclosed in U.S. Pat. No. 5,500,138, from column 7 line 42 to column 11 line 44.

The amphiphile of the present invention is preferably at a level of less than about 30%, or 25%, or 20%, or 15%, or 12%, or 10%, or 8%, or 7%, or 6%, or 5%, alternatively greater than 0.5% by weight the concentrated perfume composition.

Yet another aspect of the invention provides a concentrated perfume composition comprises a low level of water. In one embodiment, the water level in the concentrated perfume composition comprises less than about 10%, or 9%, or 8%, or 7%, or 6%, or 5%, or 4%, or 3%, or 2%, or 1%, alternatively greater than 0.5%, by weight of the composition. When water is present in the concentrated perfume composition of the present invention, often mixing is necessary to maintain a homogeneous concentrated perfume composition.

Concentrated perfume compositions with a variety of optical appearances are acceptable for the present invention. Preferably when the composition is centrifuged at 40,000 rpm for 16 hrs using a Beckman Optima L 70K ultracentrifuge outfitted with a SW 40 Ti rotor. If the composition splits into at least two phases (i.e., a top and bottom phase), the ratio of the split is no greater than 20/80 (meaning that if the length of the composition inside the centrifuge tube is measured, the length of the top phase accounts for no more than 20% of the total length the composition occupies inside the tube), more preferably no greater than 10/90, more preferably still no greater than 5/95; respectively. Most preferably, the composition does not split when subjected to centrifugation under the above-identified conditions. In one embodiment, the compositions are translucent or clear or substantially translucent or substantially clear.

In one embodiment, the concentrated perfume composition comprises a high flash point, e.g., above about 38° C., or 50° C., or 60° C., or 70° C., or 80° C., or 90° C., or 95° C., or 100° C., as measured using the closed cup flash point methodology.

As used herein, the term "perfume" includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are not included within the meaning of "perfume", as used herein. Typically, perfumes are complex mixtures of a plurality of organic compounds. In one embodiment, the perfume of the present invention may have a combined dielectric constant below about 12, or 11, or 10, or 9, or 8, or 6, or 5, or 4, alternatively greater than about 1. In another embodiment, the perfume may comprise at least 1, or 2, or 3, or 4, or 5, or 6, or 7, or 8, or 9, or 10, or 11, or 12, alternatively not greater than about 100, different individual perfume ingredients.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution. In one embodiment, the concentrated perfume composition is free or substantially free of any solvents, diluents, or carriers.

Perfume ingredients may also be suitably added as releasable fragrances, for example, as pro-perfumes or pro-fragrances as described in U.S. Pat. No. 5,652,205 Hartman et al., issued Jul. 29, 1997.

One aspect of the present invention provides for an amphiphilic agent. Amphiphilic agents of the present invention include those compounds comprising at least one hydrocarbon chain comprising at least about six carbons. It is acceptable for the hydrocarbon chain to be interrupted by a divalent linking group. Amphiphilic agents of the present invention comprise at least one electronegative atom, alternatively 2, 3, 4, 5, 6, or 7 electronegative atoms. Preferred electronegative atoms include sulfur, nitrogen, and oxygen. In one embodiment, the amphiphilic agent is chosen from a nonionic surfactant, a nonionic with a bulky head group, an alkoxylated cationic quaternary ammonium surfactant, or combinations thereof.

1. Nonionic Surfactants

In one embodiment, the amphiphilic agent is a nonionic surfactant. Preferably, the compounds of the alkyl or alkyl-aryl alkoxylated surfactants and alkyl or alkyl-aryl amine, amide, and amine-oxide alkoxylated have the following general formula:

$$R^1{}_m—Y—[(R^2—O)_z—H]_p$$

wherein each $R^1$ is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R^2$ is selected from the following groups or combinations of the following groups: $—(CH_2)_n—$ and/or $—[CH(CH_3)CH_2]—$; wherein about $1<n\leqq$about 3; Y is selected from the following groups: —O—; $—N(A)_q$-; —C(O)O—; —C(O)N—(O←)N$(A)_q$-; $—B—R^3—O—$; $—B—R^3—N(A)_q$-; $—B—R^3—C$ (O)O—; —B—$R^3$—N(→O)$(A)_q$-; and mixtures thereof; wherein A is selected from the following groups: H; $R^1$; —$(CH_2)_xCH_3$; phenyl, or substituted aryl, wherein 0≦x≦about 3 and B is selected from the following groups: —O—; —N(A)-; —C(O)O—; —C(O)N— and mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain, z is from about 1 to about 30, p is the number of ethoxylate chains, typically one or two, preferably one and m is the number of hydrophobic chains, typically one or two, preferably one and q is a number that completes the structure, usually one.

Some non-limiting preferred structures are those in which m=1, p=1 or 2, and z ≧ about 2, more preferably z≧9, q can be 1 or 0, but when p+m=3, q must be 0.

A more preferred, non-limiting class of structures are those structures in which $R^1$ comprises at least about 10 carbons, preferably at least about 12 carbons, Y═O, m=1, p =1, and z≧about 9; and even more preferred are those structures in which $R^1$ comprises at least about 10 carbons, preferably at least about 12 carbons, Y═O, m=1, p=1, and z ≧ about 12; in which $R^1$ comprises at least about 10 carbons, preferably at least about 12 carbons, Y═O, m=1, p=1, and z≧about 18.

Some nonlimiting examples of this type of preferred structure are Polystep® TD 189, Biosoft® E-840, Biosoft® E-847 and Makon® T18 from Stepan in Northfield, Ill., USA; Arlasolve® 200 and Arlasolve® 200 Liquid/Gel from Uniqema, New Castle, Del., USA. Another group of preferred nonionic surfactants includes amine-oxides. While amine-oxides may have partial or whole charges on the amine and the oxide moieties depending on the pH of the composition, these can be considered to be nonionic since these two charges sum to zero. Ethoxylated amine-oxides are even more preferred above conventional amine oxides as these materials disperse perfumes more finely and thus provide improved adsorption of the perfume. Some other preferred nonlimiting structures have m=1, y=(O←)N$(A)_q$, p=2, q=0, $R_2$═—$(CH_2)_n$—, where n =2, and z≧1. A nonlimiting example of this type of structure is an ethoxylated amine-oxide, Aromox® C/12 available from Akzo Nobel, Dobbs Ferry, N.Y., USA.

2. Nonionics with Bulky Head Groups

Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. This structure can also optionally be derivatized with one or more heterocyclic or carbohydrate unit. At least one of the heterocyclic or carbohydrate units is alkoxylated with one or more alkylene oxide chains (e.g. ethylene oxide and/or propylene oxide) each amphiphile having ≧4 moles, preferably ≧8 moles, more preferably ≧about 10 moles and most preferably ≧about 15 moles of alkylene oxide per amphiphile. The hydrocarbon groups on the amphiphile have from about 6 to about 22 carbon atoms, and are in either straight chain or branched chain configuration. Especially preferred amphilphiles have at least one hydrocarbon having from about 8 to about 18 carbon atoms with one carbohydrate or heterocyclic moiety and ≧about 10 moles of alkylene oxide, preferably ≧15 moles of alkylene oxides per amphiphile.

Preferably the compounds of the alkoxylated and non-alkoxylated nonionic surfactants with bulky head groups have the following general formulas:

$$R^1—C(O)—Y'—[C(R^5)]_m—CH_2O(R^2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)-; and mixtures thereof; and A is selected from the following groups: H; $R^1$; —$(R^2—O)_z$—H; —$(CH_2)_xCH_3$; phenyl, or substituted aryl, wherein 0≦x≦about 3 and z is from about 5 to about 30; each $R^2$ is selected from the following groups or combinations of the following groups: —$(CH_2)_n$— and/or —[$CH(CH_3)CH_2$]—; and each $R^5$ is selected from the following groups: —OH; and —$O(R^2O)_z$—H; and m is from about 2 to about 4; n is 2 or 3.

Another useful general formula for this class of amphiphiles when the amphiphile comprises a heterocycle as follows:

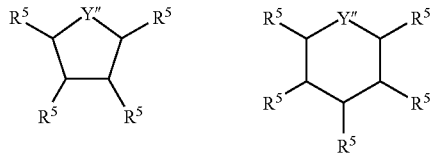

wherein Y"═N or O; and each $R^5$ is selected independently from the following: —H, —OH, —$(CH_2)xCH_3$, —$(OR^2)$—H, —$OR^1$, —OC(O)$R^1$, and —$CH_2(CH_2—(OR^2)_{z''}—H)—CH_2—(OR^2)_{z'}—C(O)R^1$. With x $R^1$, and $R^2$ as defined above in section D. Preferably the total number of z+z'+z" is at least about 5, preferably at least about 10, more preferably at least about 15, even more preferably at least about 20. In a particularly preferred form of this structure the heterocyclic ring is a five member ring with Y"═O, one $R^5$ is —H, two $R^5$ are —O—$(R^2O)_z$—H, and at least one $R^5$ has the following structure —$CH(CH_2—(OR^2)_{z'}—H)—CH_2—(OR^2)_{z'}—OC(O)R^1$ the total z+z'+z"═to from about 8≦to≦about 20 and $R^1$ is a hydrocarbon with from about 8 to about 20 carbon atoms and no aryl group. Examples of amphiphiles in this class may include Tween® 20, 21, 40, 60, and 80, 81, 85 available from Uniqema.

Another group of surfactants that can be used are polyhydroxy fatty acid amide surfactants of the formula:

$$R^6—C(O)—N(R^7)—W$$

wherein: each $R^7$ is H, $C_1$-$C_4$ hydrocarbyl, $C_1$-$C_4$ alkoxyalkyl, or hydroxyalkyl, e.g., 2-hydroxyethyl, 2-hydroxypropyl, etc., preferably $C_1$-$C_4$ alkyl, more preferably $C_1$ or $C_2$ alkyl, most preferably $C_1$ alkyl (i.e., methyl) or methoxyalkyl; and $R^6$ is a $C_5$-$C_{31}$ hydrocarbyl moiety, preferably straight chain $C_7$-$C_{19}$ alkyl or alkenyl, more preferably straight chain $C_9$-$C_{17}$ alkyl or alkenyl, most preferably straight chain $C_{11}$-$C_{17}$ alkyl or alkenyl, or mixture thereof; and W is a polyhydroxyhydrocarbyl moiety having a linear hydrocarbyl chain with at least 3 hydroxyls directly connected to the chain, or an alkoxylated derivative (preferably ethoxylated or propoxylated) thereof. W preferably will be derived from a reducing sugar in a reductive amination reaction; more preferably W is a glycityl moiety. W preferably will be selected from the group consisting of —$CH_2$—$(CHOH)_n$—$CH_2OH$, —CH$(CH_2OH)$—$(CHOH)_n$—$CH_2OH$, —$CH_2$—$(CHOH)_2$ (CHOR')(CHOH)—$CH_2OH$, where n is an integer from 3 to 5, inclusive, and R' is H or a cyclic mono- or poly-saccharide, and alkoxylated derivatives thereof. Most preferred are glycityls wherein n is 4, particularly —$CH_2$—$(CHOH)_4$—$CH_2O$. Mixtures of the above W moieties are desirable.

$R^6$ can be, for example, N-methyl, N-ethyl, N-propyl, N-isopropyl, N-butyl, N-isobutyl, N-2-hydroxyethyl, N-1-methoxypropyl, or N-2-hydroxypropyl.

$R^6$—CO—N< can be, for example, cocamide, stearamide, oleamide, lauramide, myristamide, capricamide, palmitamide, tallowamide, etc.

W can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

3. Alkoxylated Cationic Quaternary Ammonium Surfactants

Alkoxylated cationic quaternary ammonium surfactants suitable for this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having ≧about 4 moles alkylene oxide moieties (e.g. ethylene oxide and/or propylene oxide) per mole of amphiphile. Typical of this class are products obtained from the quaternization of aliphatic saturated or unsaturated, primary, secondary, or branched amines having one or two hydrocarbon chains from about 6 to about 22 carbon atoms alkoxylated with one or two alkylene oxide chains on the amine atom each having ≧about 4 moles alkylene oxide moieties. The amine hydrocarbons for use herein have from about 6 to about 22 carbon atoms, and are in either straight chain or branched chain configuration, preferably there is one alkyl hydrocarbon group in a straight chain configuration having about 8 to about 18 carbon atoms. Suitable quaternary ammonium surfactants are made with one or two alkylene oxide chains attached to the amine moiety, in average amounts of ≧about 4 moles of alkylene oxide per alkyl chain. Nonlimiting examples of this class include Ethoquad® 18/25, C/25, and O/25 from Akzo and Variquat®-66 (soft tallow alkyl bis(polyoxyethyl) ammonium ethyl sulfate with a total of about 16 ethoxy units) from Goldschmidt.

Preferably, the compounds of the ammonium alkoxylated cationic surfactants have the following general formula:

$$\{R^1_m—Y—[(R^2—O)_z—H]_p\}^+X^-$$

wherein $R^1$ and $R^2$ are as defined previously in section D above;

Y is selected from the following groups: $=N^+$-$(A)_q$; —$(CH_2)_n$—$N^+$-$(A)_q$; —B—$(CH_2)_n$—$N^+$-$(A)_2$; -(phenyl)-$N^+$-$(A)_q$; —(B-phenyl)-$N^+$-$(A)_q$; with n being from about 1 to about 4.

Each A is independently selected from the following groups: H; $R^1$; —$(R^2O)_z$—H; —$(CH_2)_xCH_3$; phenyl, and substituted aryl; where 0≦x≦about 3; and B is selected from the following groups: —O—; —NA-; —$NA_2$; —C(O)O—; and —C(O)N(A)-; wherein $R^2$ is defined as hereinbefore; q=1 or 2; and $X^-$ is an anion which is compatible with fabric softener actives and adjunct ingredients.

Preferred structures are those in which m=1, p=1 or 2, and about z≧4.

In one embodiment, the amphiphile comprises polyoxyethylene sorbitan monolaurate, also known as: polyoxyethylene (20) sorbitan monolaurate; TWEEN 20, Poe 20 sorbitan monolaurate; PSML; armotan pml-20; capmul; emsorb 6915; glycospere L-20; liposorb L-20. Polyoxyethylene sorbitan monolaurate has the molecular formula of $C_{58}H_{114}O_{26}$ and a CAS No: 9005-64-5

Another aspect of the invention provides for a method of making a perfumed fabric care composition comprising the step of adding the concentrated perfume composition of the present invention to a composition comprising one or more fabric softening actives, wherein preferably the composition comprising the fabric softening active is free or substantially free of a perfume. The concentrated perfume composition is combined with the composition comprising fabric softening active(s) such that the resulting composition comprises at least about 0.1% perfume, or greater than about 0.2%, or 0.3%, or 0.5%, or 0.7%, or 0.9%, or 1%, or 2%, or 3%, or 4%, or 5%, or 10%, alternatively less than about 30%, or less than about 25%, or 20%, or 15%, or 12%, by weight of the total fabric care composition comprising perfume and fabric softening active.

The perfumed fabric care composition comprises a ratio of perfume to amphiphile of at least about 3 to 1, alternatively 4:1, or 5:1, or 6:1, or 7:1, or 8:1, or 9:1, or 10:1, alternatively not greater than 100:1, respectively.

In one embodiment, when the perfumed fabric care composition (comprising a fabric softening active) of the present invention comprises a relatively high level of perfume (e.g., about 2 to 10% perfume by weight of the fabric care composition), the fabric care composition preferably comprises less than about 3% of the amphiphile, alternatively less than about 2%, or 1%, or 0.5%, or 0.4%, or 0.3%, or 0.2%, or 0.1%, alternatively greater than about 0.001%, of the amphiphile by weight of the perfume fabric care composition.

The term "fabric softening active" is used herein in the broadest sense to include any compound that is known to impart a softening benefit to fabric during a laundering operation. In one embodiment, the fabric softening active is chosen from a quaternary ammonium compound, an ester quaternary ammonium compound, a quaternary amine compound, a cationic starch compound, a clay compound, a fatty acid compound, a triglyceride compound, a diglyceride compound, or combinations thereof. Typical minimum levels of incorporation of the fabric softening active in the present compositions are at least about 0.5%, or 1%, or 2%, or 3%, or 4%, or 5%, or 6%, or 7%, or 8%, or 9%, or 10%, or 11%, or 12%; alternatively not greater than 90%, or 30%, or 20%; by weight of the composition.

One example of a fabric softening active is a cationic starch compound. The term "cationic starch" is used herein in the broadest sense. Suitable cationic starch compounds are described in U.S. Pat. Pub. No. 2004/0204337 A1, published Oct. 14, 2004 to Corona et al., In one embodiment, the compositions of the present invention generally comprise cationic starch at a level of from about 0.1% to about 7%, more preferably 0.1% to about 5%, more preferably from about 0.3% to about 3%, and still more preferably from about 0.5% to about 2.0%, by weight of the composition.

Another example of a fabric softening active is a quaternary ammonium or quaternary amine compound. In one embodiment, the fabric softening active is a diester quaternary ammonium compound or other nitrogen-based compound or combination thereof. Examples include those described in U.S. Pat. Pub. No. 2004/0204337 A1, published Oct. 14, 2004 to Corona et al., from paragraphs 30-79; U.S. Pat. Pub. No. 2004/0229769 A1, published Nov. 18, 2005, to Smith et al., on paragraphs 26-31; or U.S. Pat. No. 6,494,920, at column 1, line 51 et seq. detailing an "esterquat" or a quatemized fatty acid triethanolamine ester salt. Other fabric softening actives for clear or translucent liquid fabric softening compositions are described in U.S. Pat. Nos. 5,747,443; 5,759,990; and 6,323,172. Other fabric softening actives that can be used herein are disclosed, at least generically for the basic structures, in U.S. Pat. Nos. 3,861,870; 4,308,151; 3,886,075; 4,233,164; 4,401,578; 3,974,076; and 4,237,016. Examples of more biodegradable fabric softeners can be found in U.S. Pat. Nos. 3,408,361; 4,709,045; 4,233,451; 4,127,489; 3,689,424; 4,128,485; 4,161,604; 4,189,593; and 4,339,391.

The fabric softening active, in one embodiment, is chosen from ditallowoyloxyethyl dimethyl ammonium chloride, dihydrogenated-tallowoyloxyethyl dimethyl ammonium chloride, dicanola-oyloxyethyl dimethyl ammonium chloride, ditallow dimethyl ammonium chloride, tritallow methyl ammonium chloride, methyl bis(tallow amidoethyl)2-hydroxyethyl ammonium methyl sulfate, methyl bis(hydrogenated tallow amidoethyl)-2-hydroxyethyl ammonim methyl sulfate, methyl bis (oleyl amidoethyl)-2-hydroxyethyl ammonium methyl sulfate, ditallowoyloxyethyl dimethyl ammonium methyl sulfate, dihydrogenated-tallowoyloxyethyl dimethyl ammonium chloride, dicanola-oyloxyethyl dimethyl ammonium chloride, N-tallowoyloxyethyl-N-tallowoylaminopropyl methyl amine, 1,2-bis(hardened tallowoyloxy)-3-trimethylammonium propane chloride, and combinations thereof.

In another example, the fabric softening active is a clay. Clays are described in U.S. Pat. Appl. Publ. US 2003/0216274 A1, to Valerio Del Duca, et al., published Nov. 20, 2003. Examples of clays include smectites, kaolinites, and illites. Smectite clays are disclosed in the U.S. Pat. Nos. 3,862,058, 3,948,790, 3,954,632 and 4,062,647. Another aspect of the invention provides concentrated perfume composition and fabric care compositions (perfumed or unperfumed) comprising cationic polymers. In one embodiment, the composition comprises from about 0.001% to about 10%, alternatively from about 0.01% to about 5%, alternatively from about 0.1% to about 2%, of a cationic polymer. In one embodiment, the cationic polymer may comprise a molecular weight of from about 500 to about 1,000,000, alternatively from about 1,000 to about 500,000, alternatively from about 1,000 to about 250,000, alternatively from about 2,000 to about 100,000 Daltons. In another embodiment, the cationic polymer comprises a charge density of at least about 0.01 meq/gm., alternatively from about 0.1 to about 8 meq/gm., alternatively from about 0.5 to about 7, and alternatively from about 2 to about 6. Cationic polymers are described in U.S. Pat. No. 6,492,322 B1, at col. 6, line 65 et seq.

In one embodiment, the cationic polymer comprises a polysaccharide gum. Of the polysaccharide gums, guar and locust bean gums, which are galactomannam gums are available commercially, and are preferred. In another embodiment, the cationic polymer comprises cationic guar gum. Guar gums are marketed under Trade Names CSAA M/200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar. Cationic guar gums and methods for making them are disclosed in British Pat. No. 1,136,842 and U.S. Pat. No. 4,031,307. Preferably they have a D.S. of from 0.1 to about 0.5.

The fabric care composition of the present invention may be used in any manner suitable for washing, rinsing, or treating laundry. For example, the fabric care composition may comprise a liquid, rinse-added, fabric softening composition suitable for use in a rinse cycle of an automatic laundry washing machine. Alternatively, the fabric care composition may be one used in a handwashing context wherein the fabric care composition is a liquid, rinse-added, fabric softening composition and used in a so-called "single rinse" composition. See EP 1 370 634 B1. Generally, the fabric care compositions of the present invention can be in solid (powder, granules, bars, tablets), dimple tablets, liquid, paste, gel, spray, stick or foam forms.

In another embodiment, the compositions of the present invention may comprise any one or more adjunct ingredients. In yet another embodiment, the composition of the present invention may be free or essentially free of any one or more adjunct ingredients. The term "adjunct ingredients" may include: a perfume, dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, anti-shrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, anti-microbial, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, and combinations thereof. In one embodiment, the composition comprises an adjunct ingredient up to about 2% by weight of the composition. In yet another embodiment, the compositions of the present invention may be free or substantially free of any one or more adjunct ingredients.

In one embodiment, the perfume of the present invention may have a combined dielectric constant below about 12, or 11, or 10, or 9, or 8, or 6, or 5, or 4, alternatively greater than about 1. In another embodiment, the perfume may comprise at least 1, or 2, or 3, or 4, or 5, or 6, or 7, or 8, or 9, or 10, or 11, or 12, alternatively not greater than about 100, different individual perfume ingredients. A method of measuring the dielectric constant of perfume and perfume-amphiphile mixtures is provided. The dielectric constant of perfumes and perfume-amphiphile mixtures is measured using a Dielectric Constant Meter model 870 made by Scientifica. The dielectric constant meter comprises a meter that compensates for the conductivity of the sample and provides the dielectric constant as a read-out and a probe consisting of two concentric cylinders. The probe is constructed from two precision cylinders of stainless steel with a gap maintained by nylon screws. The probe is attached to the meter by insulated coaxial cables with the outer cylinder connected to the measurement signal source a 6 volt rms, 10 khz, very low distortion sine wave. The inner cylinder is connected to the detection circuitry. The dimensions of the outermost cylinder are 2 cm in diameter and 8 cm long. Before measuring a liquid, the probe is cleaned with a low-dielectric constant hydrocarbon fluid followed by gentle drying with compressed air. The perfume or perfume-amphiphile mixture is measured by immersing the probe in about 40 ml of the liquid contained in a 50 ml graduated cylinder. The probe is suspended in the center of the liquid such that the probe only contacts the liquid being measured. The amplitude of the sine wave is set using toggle switches that select either 1-20 or 1-200. The setting is chosen to bracket the dielectric constant. The control panel has coarse and fine adjusting knobs to compensate for the conductivity and LEDs that act as signal devices to indicate the dials are set correctly. The coarse dial is adjusted first and this six position dial is turned until the LED marked "high" is not on, but the LED marked "low" is may still be illuminated. Next adjust the fine dial to extinguish the LED marked "low". When the dials are adjusted so both LEDs are extinguished, the conductivity is balanced and the read-out is the dielectric constant of the liquid, a unitless quantity. The samples are measured at a temperature between 22-27° C.

EXAMPLES

Example 1

The following are non-limiting examples of the concentrated perfume compositions of the present invention. The compositions of Example 1 are made using simple mixing of the perfume with the amphiphile.

| INGRE- | EXAMPLE 1. | | | | | | |
|---|---|---|---|---|---|---|---|
| DIENTS | I | II | III | IV | V | VI | VII |
| Arlasolve ® 200[a] | 10% | — | — | — | — | — | — |
| Arlasovle ® 200 Liquid/Gel[b] | — | 10% | — | — | — | — | — |
| Polystep ® TD189[c] | — | — | 10% | — | — | — | — |
| Ethoquad C/25[d] | — | — | — | 10% | — | — | — |
| Tween ® 20[e] | — | — | — | — | 10% | — | — |

-continued

| INGRE- | EXAMPLE 1. | | | | | | |
|---|---|---|---|---|---|---|---|
| DIENTS | I | II | III | IV | V | VI | VII |
| Aromox ® C/12[f] | — | — | — | — | — | 10% | — |
| Neodol 23-9[g] | — | — | — | — | — | — | 10% |
| Perfume | 90.0% | 86.1% | 88.9% | 90% | 89.5% | 80% | 90% |
| Balance[j] | — | 3.9 | 1.1% | — | 0.5% | 10% | — |

TABLE 2

Table of Amphiphilic Agents

| | Trade Name | Chemical Name | Activity |
|---|---|---|---|
| a | Arlasolve 200 | Polyoxyethylene (20) isohexadecyl ether | 100% |
| b | Arlasolve 200 Liquid/Gel | Polyoxyethylene (20) isohexadecyl ether | 72% |
| c | Polystep ® TD 189 | Polyoxyethylene (18) tridecyl ether | 90% |
| d | Ethoquad C/25 | Ethoxylated alkyl ammonium chloride | 100% |
| e | Tween 20 SD | Polyoxyethylene (20) sorbitan monolaurate | 90-100% |
| f | Aromox C/12 | Ethanol2,2'-iminobis-,N-coco alkyl derives. | 49-53% |
| g | Neodol 23-9 | Alkyl ethoxylate with a mixed chain length of 12-13 carbons and an average of 9 ethoxylate groups | 100% |

j. The balance is the non-active portion of the amphiphilic agent.

Example 2

The following are non-limiting examples of the fabric care compositions of the present invention.

| INGREDIENTS | VIII | IX | X | XIII | XIV | XV | XVI | XVII |
|---|---|---|---|---|---|---|---|---|
| Fabric Softening Active[a] | 14.00% | 14.00% | 14.00% | 18.51% | 4.67% | — | — | 2.50% |
| Fabric Softening Active[b] | — | — | — | — | — | 18.00% | 15.00% | — |
| Fabric Softening Active[c] | — | — | — | — | — | 3.00% | — | — |
| Ethanol | 2.28% | 2.28% | 2.28% | 2.91% | 0.76% | 2.45% | 2.04% | 0.41% |
| Isopropyl Alcohol | — | — | — | — | — | 0.33% | — | — |
| Cationic Starch[d] | 1.00% | 2.00% | 0% | 1.68% | 0.67% | 1.68% | 2.00% | 0.35% |
| Perfume | 1.58% | 1.58% | 1.58% | 1.28% | 0.50% | 1.30% | 2.00% | 0.3% |
| TMPD[e] | — | — | — | — | — | 5.00% | 4.50% | — |
| Phase Stabilizing Polymer[f] | 0.25% | 0.25% | 0.25% | 0.25% | — | 0.25% | 0.25% | — |
| Calcium Chloride | 0.250% | 0.300% | 0.350% | 0.545% | — | 0.545% | 0.445% | — |
| DTPA[g] | 0.005% | 0.005% | 0.005% | 0.005% | 0.003% | 0.20% | 0.02% | — |
| Preservative[h] | 7.5 ppm | 7.5 ppm | 7.5 ppm | 7.5 ppm | 7.5 ppm | — | — | 7.5 ppm |
| Antifoam[i] | 0.011% | 0.011% | 0.011% | 0.011% | 0.011% | — | — | — |
| Dye | 22 ppm | 22 ppm | 22 ppm | 22 ppm | 22 ppm | 11 ppm | 11 ppm | — |
| Amphiphilic Agent[j] | 0.05-0.15 | 0.05-0.15 | 0.05-0.15 | 0.05-0.15 | 0.025-0.5 | 0.05-0.13 | 0.05-0.2 | 0.025-0.5 |
| Ammonium Chloride | 0.1% | 0.1% | 0.1% | 0.1% | — | — | — | — |

-continued

| INGREDIENTS | VIII | IX | X | XIII | XIV | XV | XVI | XVII |
|---|---|---|---|---|---|---|---|---|
| Hydrochloric Acid | 0.012% | 0.012% | 0.012% | 0.0125% | 0.0004% | 0.016% | 0.016% | 0.002% |
| Deionized Water | Balance | Balance | Balance | Balance | Balance | Balance | Balance | Balance |

[a]N,N-di(tallowoyloxyethyl)-N,N-dimethylammonium chloride or
[b]N,N-di(canola-oyloxyethyl)-N,N-dimethylammonium chloride.
[c]Methyl bis(tallow amidoethyl)2-hydroxyethyl ammonium methyl sulfate.
[d]Cationic starch based on common maize starch or potato starch, containing 25% to 95% amylose and a degree of substitution of from 0.02 to 0.09, and having a viscosity measured as Water Fluidity having a value from 50 to 84.
[e]2,2,4-trimethyl-1,3-pentanediol.
[f]Copolymer of ethylene oxide and terephthalate having the formula described in U.S. Pat. No. 5,574,179 at col. 15, lines 1-5, wherein each X is methyl, each n is 40, u is 4, each $R^1$ is essentially 1,4-phenylene moieties, each $R^2$ is essentially ethylene, 1,2-propylene moieties, or mixtures thereof.
[g]Diethylenetriaminepentaacetic acid.
[h]KATHON ® CG available from Rohm and Haas Co.
[i]Silicone antifoam agent available from Dow Corning Corp. under the trade name DC2310.
[j]An amphiphilic agents selected from Table 2.

The following examples demonstrate process methods for incorporating perfume into a fabric care composition by using a concentrated perfume composition. The concentrated perfume composition can be made prior to the start of processing (EXAMPLE 3) or the concentrated perfume composition can be created in-line as part of the processing routine (EXAMPLE 4).

Example 3

An example of a fabric care product made using a concentrated perfume composition is provided. A concentrated perfume composition is made by pre-mixing 5000 g of a perfume with a combined dielectric constant value of 6.74 and 581.5 g of TWEEN 20. Use the procedure detailed in FIG. 1 below to add the concentrated perfume composition to the fabric care composition. The concentrated perfume composition is added to the fabric care composition at a level of 1.65%, by weight of the fabric care composition, to achieve a level of 1.5% of the perfume by weight of the fabric care composition. Table 3 (as provided below) details the results of perfume incorporation when using a concentrated perfume composition that is created prior to processing. These results can be compared to results of runs 11-12 in EXAMPLE 4 in which neat perfume is incorporated into the fabric care composition. When the neat perfume with a dielectric constant of 6.74 is incorporated into the fabric care composition, the perfume splits out of the fabric care composition. When the perfume with a dielectric constant of 6.74 is incorporated into a fabric care composition as a concentrated perfume composition, the perfume incorporation is successful.

TABLE 3 details of perfume incorporation when using a concentrated perfume composition created prior to the start of processing and results of the procedure.

| Run | Total Flow Rate (kg/min) | Base Flow Rate (kg/min) | Concentrated Perfume Composition Flow Rate (gm/min) | SMX # elements | Back mix tank Residence Time (minutes) | Perfume Incorp. |
|---|---|---|---|---|---|---|
| 1 | 12.52 | 12.3 | 209.1 | 12 | 0.0 | Good |
| 2 | 12.52 | 12.3 | 209.1 | 12 | 5.0 | Good |
| 3 | 12.52 | 12.3 | 209.1 | 12 | 10.0 | Good |
| 4 | 19.1 | 18.8 | 319.0 | 12 | 0 | Good |
| 5 | 19.1 | 18.8 | 319.0 | 12 | 3.5 | Good |
| 6 | 19.1 | 18.8 | 319.0 | 12 | 7.0 | Good |
| 7 | 25.6 | 25.2 | 427.5 | 12 | 0.0 | Good |
| 8 | 25.6 | 25.2 | 427.5 | 12 | 2.5 | Good |
| 9 | 25.6 | 25.2 | 427.5 | 12 | 5.0 | Good |

FIG. 1 is a schematic of a procedure for adding a concentrated perfume composition to the fabric care composition.

Example 4

An example of adding a concentrated perfume composition created by in-line mixing of the perfume and amphiphile just prior to addition of the concentrated perfume composition to the fabric care composition is provided.

In runs 1-9 below, a perfume (with dielectric constant=6.74) and is blended with Arlasolve 200 Liquid Gel, amphiphilic agent, by in-line mixing to create a concentrated perfume composition followed by immediate in-line injections of the concentrated perfume composition into the fabric care composition. The process is shown in FIG. 2. The amphiphilic agent used for this example is Arlasolve 200 Liquid Gel. The perfume and amphiphilic agent are added to achieve a level of 1.5% of the perfume and 0.23% of the Arlasolve 200 Liquid Gel by weight of the product composition. Runs 11-12, which use neat perfume instead of a concentrated perfume composition demonstrate that the neat perfume is not adequately incorporated. In runs 11-12, the perfume splits out of the fabric care composition. Runs 11-12 demonstrate the need for incorporating perfume as a concentrated perfume composition into the fabric care composition.

TABLE 4

Details of perfume incorporation by creating a concentrated perfume composition in-line immediately prior to addition of the concentrated perfume composition to the fabric care composition (runs 1-9) and incorporation of neat perfume as a comparison (runs 11-12) along with the results for both procedures.

| Run | Total Flow Rate (kg/min) | Base Flow Rate (kg/min) | Perfume Flow Rate (gm/min) | Arlasolve liquid Gel Flow rate (gm/min) | SMX # elements | Back mix tank Residence Time (minutes) | Perfume Incorpor. |
|---|---|---|---|---|---|---|---|
| 1 | 10.4 | 10.25 | 156.5 | 25.3 | 12 | 0.0 | Good |
| 2 | 10.4 | 10.25 | 156.5 | 25.3 | 12 | 5.0 | Good |
| 3 | 10.4 | 10.25 | 156.5 | 25.3 | 12 | 10.0 | Good |
| 4 | 16.0 | 15.69 | 239.5 | 38.7 | 12 | 0.0 | Good |
| 5 | 16.0 | 15.69 | 239.5 | 38.7 | 12 | 3.5 | Good |
| 6 | 16.0 | 15.69 | 239.5 | 38.7 | 12 | 7.0 | Good |
| 7 | 21.5 | 21.08 | 321.8 | 52.0 | 12 | 0 | Good |
| 8 | 21.5 | 21.08 | 321.8 | 52.0 | 12 | 2.5 | Good |
| 9 | 21.5 | 21.08 | 321.8 | 52.0 | 12 | 5.0 | Good |
| 10 | 10.4 | 10.25 | 156.5 | 0 | 12 | 0.0 | Split |
| 11 | 10.4 | 10.25 | 156.5 | 0 | 12 | 5.0 | Split |

Example 5

In Examples 1-6 below, runs are made by blending a perfume (with dielectric constant=6.38) and Arlasolve 200 Liquid Gel, an amphiphilic agent, by in-line mixing to create a concentrated perfume composition immediately prior to injecting the concentrated perfume composition in-line into a fabric care composition. The process is shown in FIG. 2. The perfume and amphiphilic agent are added to achieve of a level 1.75% of the perfume and 0.27% of the Arlasolve 200 Liquid Gel by weight of the product composition.

| Run | Total Flow Rate (kg/min) | Base Flow Rate (kg/min) | Perfume Flow Rate (gm/min) | Arlasolve liquid Gel flow rate (gm/min) | SMX # elements | Back mix tank Residence Time (minutes) | Perfume Incorp. |
|---|---|---|---|---|---|---|---|
| 1 | 12.52 | 12.27 | 219.1 | 35.4 | 12 | 0.0 | Good |
| 2 | 12.52 | 12.27 | 219.1 | 35.4 | 12 | 5.0 | Good |
| 3 | 12.52 | 12.27 | 219.1 | 35.4 | 12 | 10.0 | Good |
| 4 | 19.1 | 18.71 | 334.3 | 54.0 | 12 | 0.0 | Good |
| 5 | 19.1 | 18.71 | 334.3 | 54.0 | 12 | 3.5 | Good |
| 6 | 19.1 | 18.71 | 334.3 | 54.0 | 12 | 7.0 | Good |

All documents cited in the DETAILED DESCRIPTION OF THE INVENTION are, in relevant part, incorporated herein by reference; the citation of any document is not to be construed as an admission that it is prior art with respect to the present invention While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A concentrated perfume composition comprising at least about 90% of a perfume, by weight of the composition, having combined dielectric constant below about 9 from about 0.5% to about 7% of an amphiphile, by weight of the composition, wherein the amphiphile comprises polyoxyethylene sorbitan monolaurate; less than about 5% water, by weight of the composition; and less than about 5% of a non-aqueous solvent, by weight of the composition.

2. A method of making a fabric care composition comprising the step of adding a concentrated perfume composition to a fabric care composition comprising a quaternary ammonium compound, wherein the concentrated perfume composition comprises:

(a) at least about 70% of a perfume, by weight of the composition; and (b) from about 1% to about 30% of polyoxyethylene sorbitan monolaurate, by weight of the composition.

3. A concentrated perfume composition comprising at least about 70% of a perfume, by weight of the composition; and from about 1% to about 30% of an amphiphile comprising polyoxyethylene sorbitan monolaurate.

* * * * *

UNITED STATES PATENT AND TRADEMARK OFFICE

CERTIFICATE OF CORRECTION

PATENT NO. : 7,405,187 B2
APPLICATION NO. : 11/444667
DATED : July 29, 2008
INVENTOR(S) : Gayle Marie Frankenbach et al.

It is certified that error appears in the above-identified patent and that said Letters Patent is hereby corrected as shown below:

Column 8
Line 32, delete "-$(OR^2)$-" and insert -- -$(OR^2)_z$- --.
Line 41, delete "-$(OR^2)_{z'}$" and insert -- -$(OR^2)_{z''}$ --.
Line 42, before the word "the" insert -- with --.

Column 10
Line 67, delete "quatemized" and insert -- quaternized --.

Claim 1
Line 3, after "ing" insert -- a --.
Line 3, after "9" insert -- ; --.

Signed and Sealed this

Nineteenth Day of May, 2009

JOHN DOLL
*Acting Director of the United States Patent and Trademark Office*

UNITED STATES PATENT AND TRADEMARK OFFICE

CERTIFICATE OF CORRECTION

PATENT NO. : 7,405,187 B2
APPLICATION NO. : 11/444667
DATED : July 29, 2008
INVENTOR(S) : Gayle Marie Frankenbach et al.

It is certified that error appears in the above-identified patent and that said Letters Patent is hereby corrected as shown below:

Column 8
Line 32, delete "-$(OR^2)$-" and insert -- -$(OR^2)_z$- --.
Line 41, delete "-$(OR^2)_{z'}$" and insert -- -$(OR^2)_{z''}$ --.
Line 42, before the word "the" insert -- with --.

Column 10
Line 67, delete "quatemized" and insert -- quaternized --.

Column 19, Claim 1
Line 16, after "ing" insert -- a --.
Line 16, after "9" insert -- ; --.

This certificate supersedes the Certificate of Correction issued May 19, 2009.

Signed and Sealed this

Ninth Day of June, 2009

John Doll

JOHN DOLL
*Acting Director of the United States Patent and Trademark Office*